US005303464A

United States Patent [19]

Neff

[11] Patent Number: 5,303,464

[45] Date of Patent: Apr. 19, 1994

[54] APPARATUS FOR REPLACEMENT OF RING TRAVELERS ON SPINNING OR TWISTING RINGS

[75] Inventor: Andreas Neff, Pfäffikon, Switzerland

[73] Assignee: Bräcker AG, Pfäffikon, Switzerland

[21] Appl. No.: 844,111

[22] Filed: Mar. 2, 1992

[30] Foreign Application Priority Data

Mar. 25, 1991 [CH] Switzerland ..... 00902/91

[51] Int. Cl.[5] ..... B23P 19/04; B23Q 7/10

[52] U.S. Cl. ..... 29/765; 29/229; 29/809

[58] Field of Search ..... 29/229, 235, 241, 765, 29/809

[56] References Cited

U.S. PATENT DOCUMENTS 4,373,247 2/1983 Holenstein et al. ..... 29/765 X
4,575,933 3/1986 Neff ..... 29/765

FOREIGN PATENT DOCUMENTS 2226337 6/1990 United Kingdom .

OTHER PUBLICATIONS

"ITMA-Vorschau Garnherstellung", Fortsetzung aus Meilliand Textilberichte Sep. 1987, Seiten 693-694.

*Primary Examiner*—Mark Rosenbaum

*Assistant Examiner*—S. Thomas Hughes

*Attorney, Agent, or Firm*—Anderson Kill Olick & Oshinsky

[57] ABSTRACT

An apparatus for automated replacement of ring travelers on spinning or twisting rings is disclosed comprising generally a housing having two planar support members, parallel to each other. A lift-out device is pivotably supported in a first of the two planar members and a device for the attachment of a new ring traveler is supported in the second plane, parallel to the first plane. The devices function by guide systems, pivotable by eccentric cams, located on a common drive shaft to be able to move the two devices between an operational and an off position. A housing, containing the two devices, is mobile along a ring rail of a spinning machine. The lift-out device lifts out a ring traveler which is to be replaced from the spinning ring on the ring rail. The attachment device subsequently attaches a new ring traveler from a magazine rod onto the spinning ring. Because of the small distance in longitudinal direction between the unlatching and latching position of the ring rail, replacement of the ring traveler at the spinning ring can be accomplished in the same position of the apparatus. The magazine rod is continuously fed a new ring traveler from a coil upon which a string containing ring travelers is coiled.

13 Claims, 7 Drawing Sheets

13
2
9
7
46
C
30
8
32
66
39
36
24
3
12
14
15
17
18
19
16
10
102
103
A
B
C
D

APPARATUS FOR REPLACEMENT OF RING TRAVELERS ON SPINNING OR TWISTING RINGS

FIELD OF THE INVENTION

The present invention relates to spinning machines and more particularly to automated replacement of ring travelers on spinning or twisting rings.

BACKGROUND OF THE INVENTION

Ring travelers in spinning machines are subject to wear, such as thread rupture. They must therefore be regularly replaced. In addition to the regular replacement, individual ring travelers must be replaced upon the occurrence of any defects.

Ring traveler replacement involves several steps, including stopping the spinning machine, locating the ring traveler at any random point of a spinning ring and bringing it forward and unlatching it, wherein the thread is released and assumes an indefinite position. A new ring traveler must then be latched onto the spinning ring, whereupon the thread must be hung or slung into the new ring traveler. Ring traveler replacement operations had previously been performed either manually, using, for example, simple tools such as a hook, for unlatching and latching of the ring traveler or a tongue-shaped tool for the latching of a new ring traveler from a storage magazine. These tools require manual dexterity, which can be achieved only by practice or experience.

To overcome these and other disadvantages of previous ring traveler replacement operations, it is an object of the present invention to automate the replacement of ring travelers on spinning or twisting rings.

A further object of the invention is to provide an apparatus which may be coupled with a doffing or threading trolley arranged to be displaceable along a spinning machine, wherein the apparatus may sling the new thread into the new ring traveler when replacing the ring traveler or to reconnect a severed thread.

Another object of the invention is to obviate dependence upon operating personnel (who may have more or less manual dexterity) and also to employ the apparatus throughout a twenty-four hour day.

An additional object of the invention is to perform replacement of ring travelers in a uniform, dependable and rapid sequence of operations.

SUMMARY OF THE INVENTION

To achieve these and other objects of the invention, which will become apparent hereafter, an apparatus for replacement of ring travelers on spinning or twisting rings, comprising two adjacent devices controlled preferably by a common shaft is disclosed. One device unlatches a ring traveler, which must be exchanged, and the other latches a new ring traveler. The apparatus is operable without interruption and includes a magazine containing several thousand ring travelers such that an unlatched ring traveler cannot fall to the ground or into the manufactured product, but rather, are deposited into a collection container of the apparatus.

The invention will be better understood by the detailed description of the preferred embodiment in conjunction with the appended drawings, of which:

Figure 2:
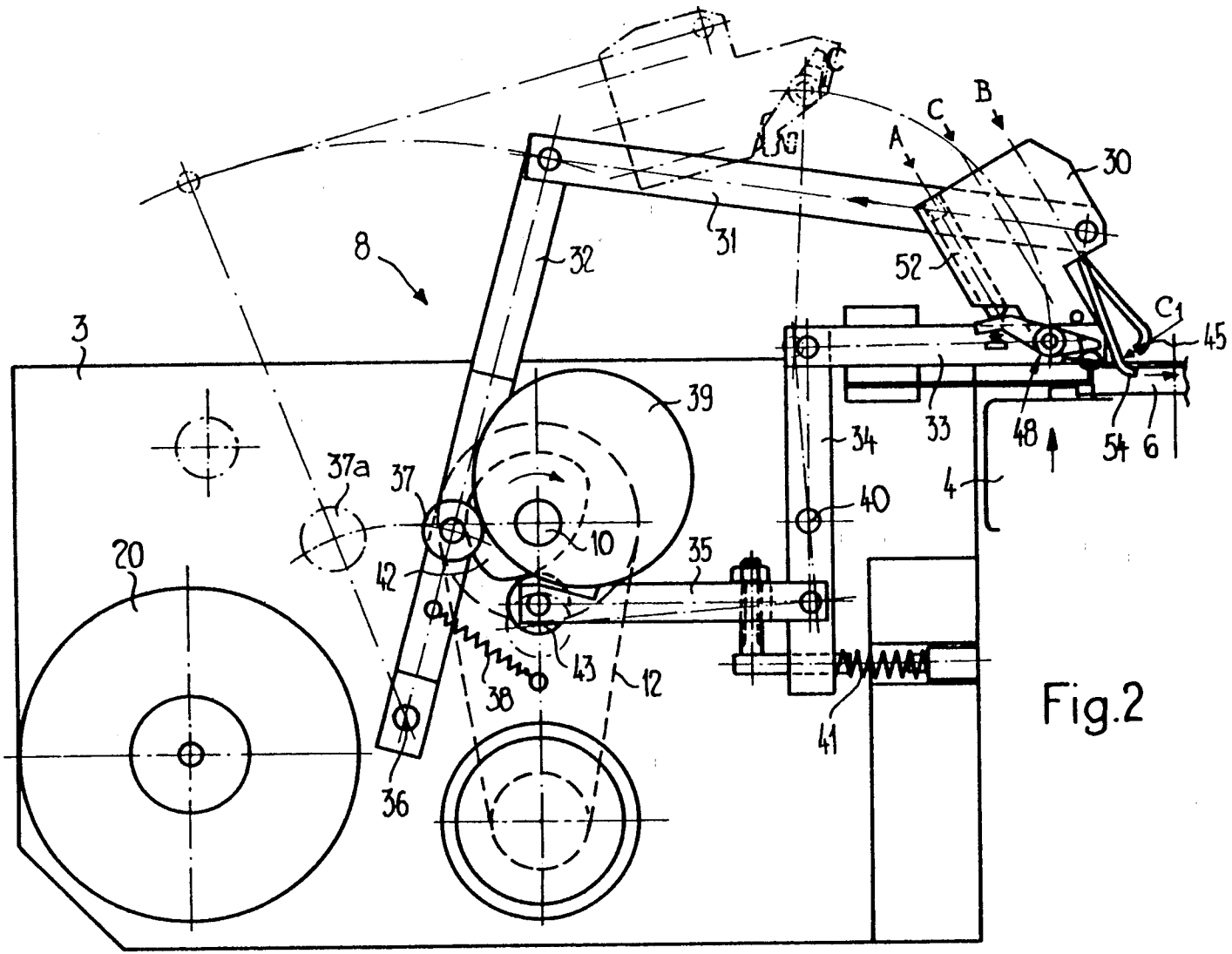
FIG. 2 is a view across cross-sectional line II—II in FIG. 1, depicting a lift-out or takeout device of the apparatus.

FIG. *2a* is a detailed side view of the head piece of the lift-out device of FIG. 2;

FIG. *2b* is a side view of the head piece shown in FIG. *2a;*

Figure 1:
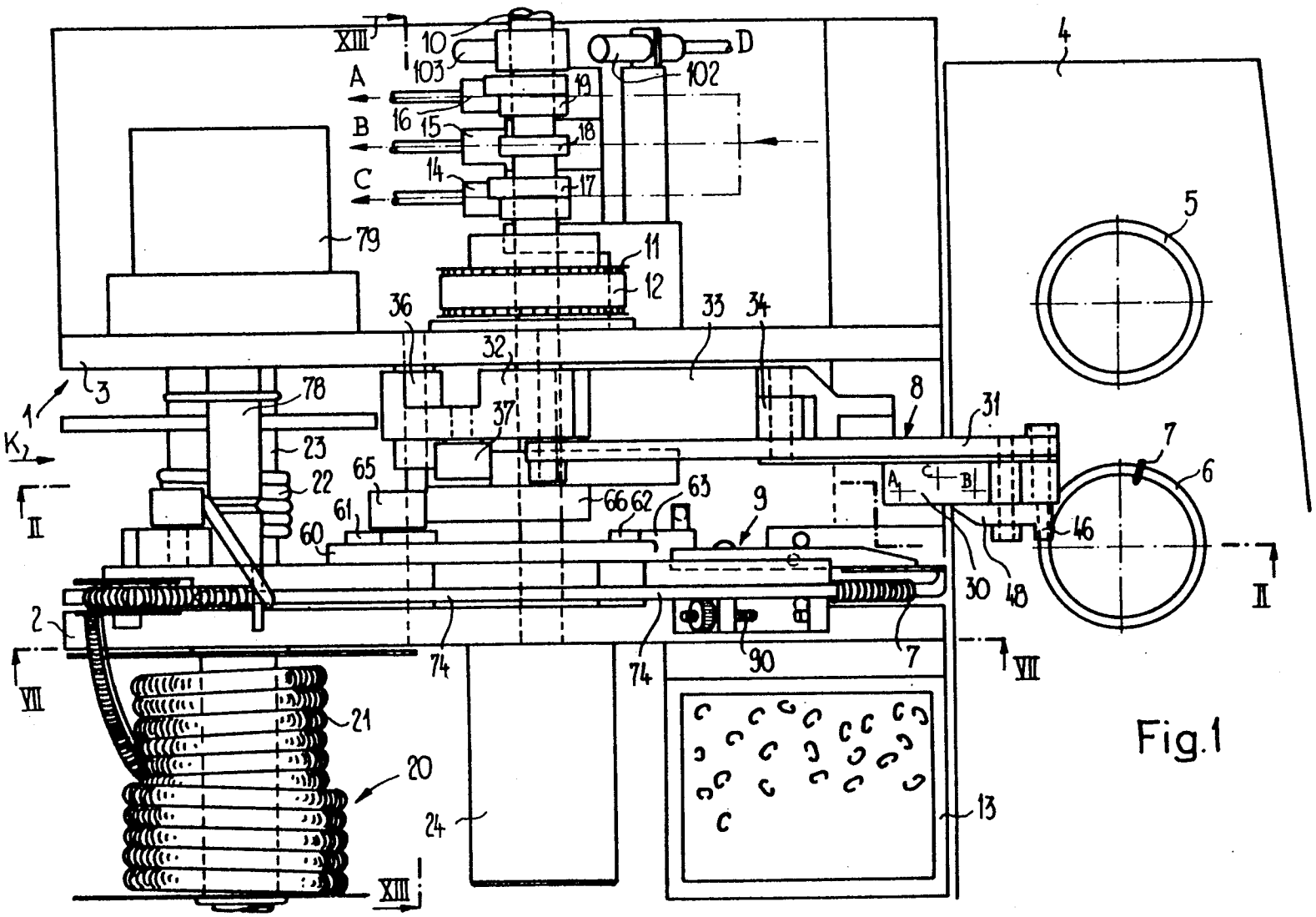
FIG. 1 is a plan view of the apparatus for replacement of ring travelers on spinning or twisting rings in front of a ring rail of a spinning machine.
Figure 4:
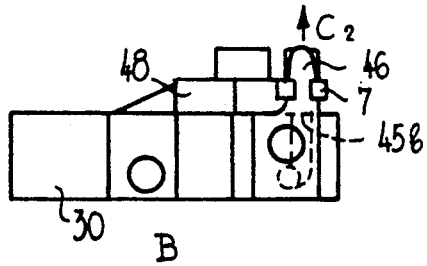
Figure 3:
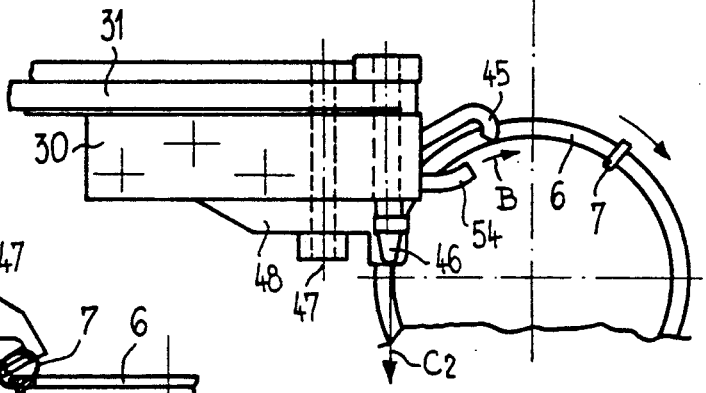
Figure 5:
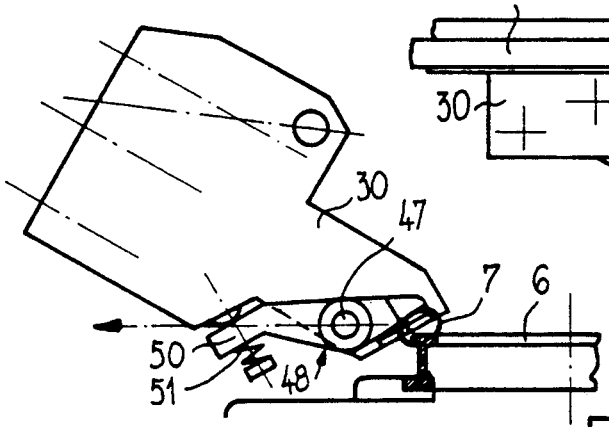
Figure 6:
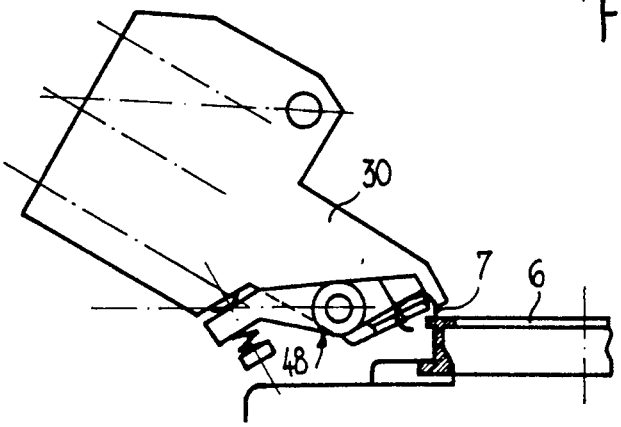
Figure 7:
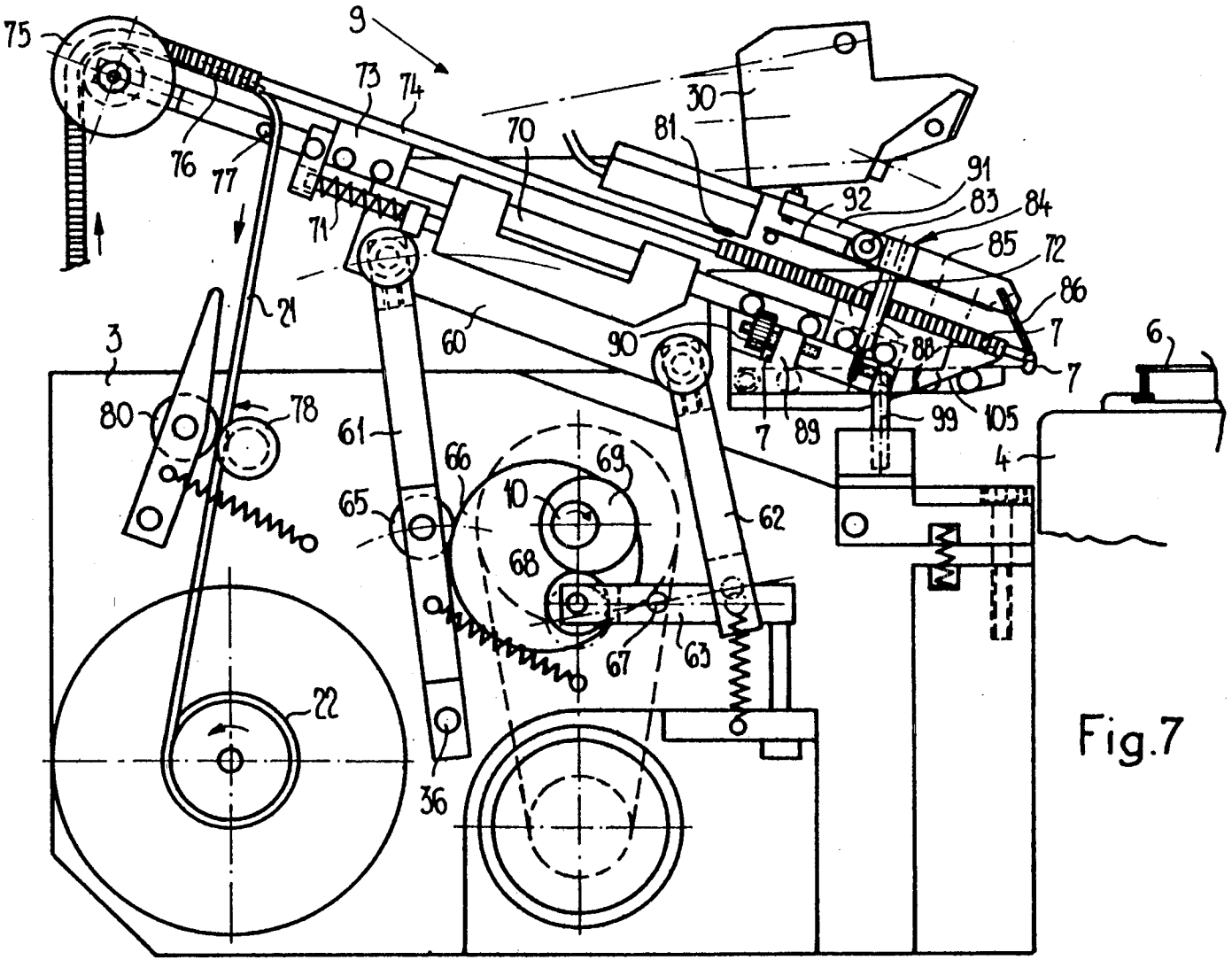
Figure 8:
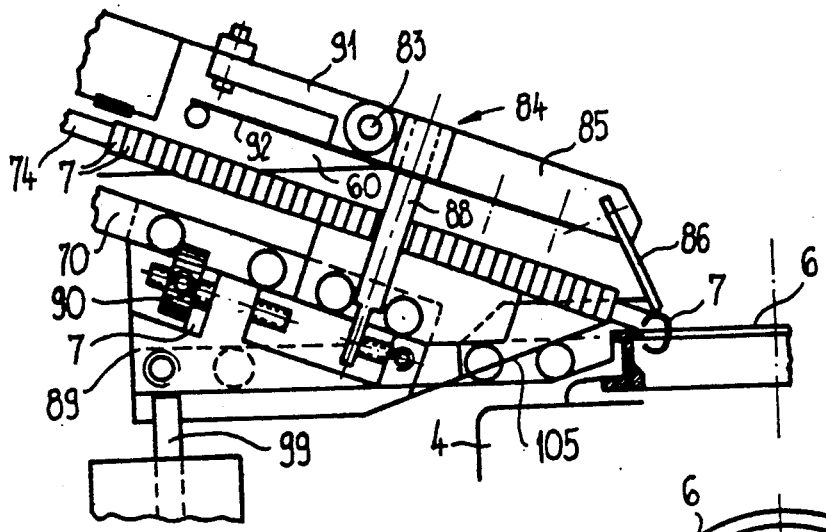
Figure 9:
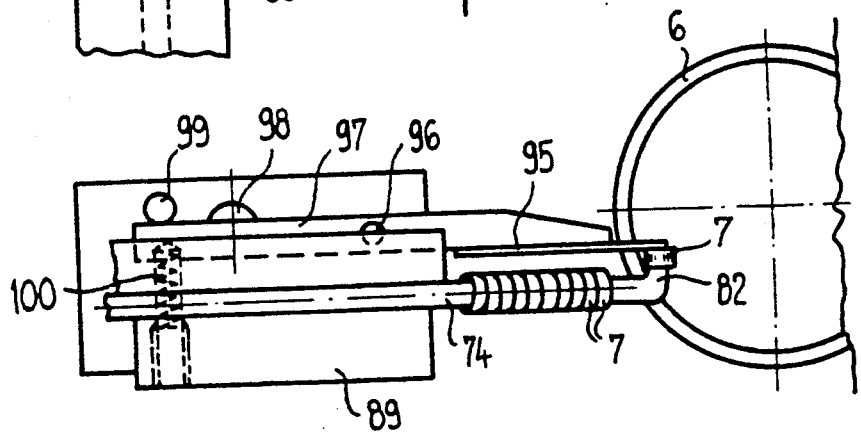
Figure 10:
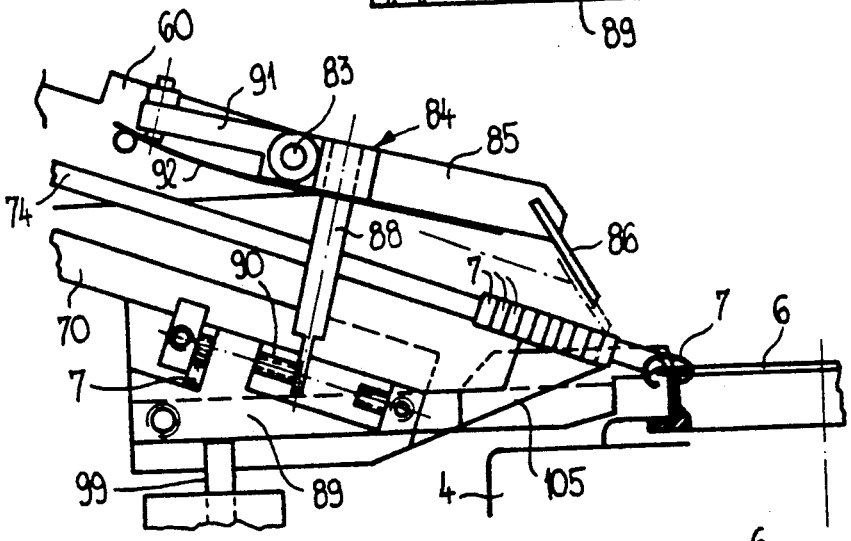
Figure 11:
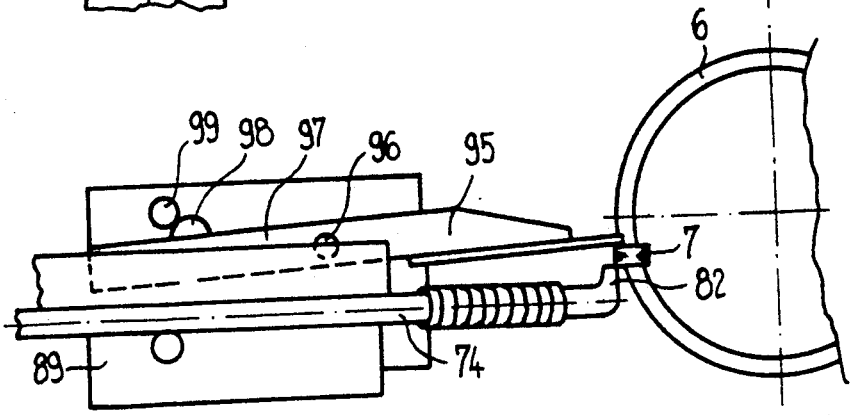
Figure 12:
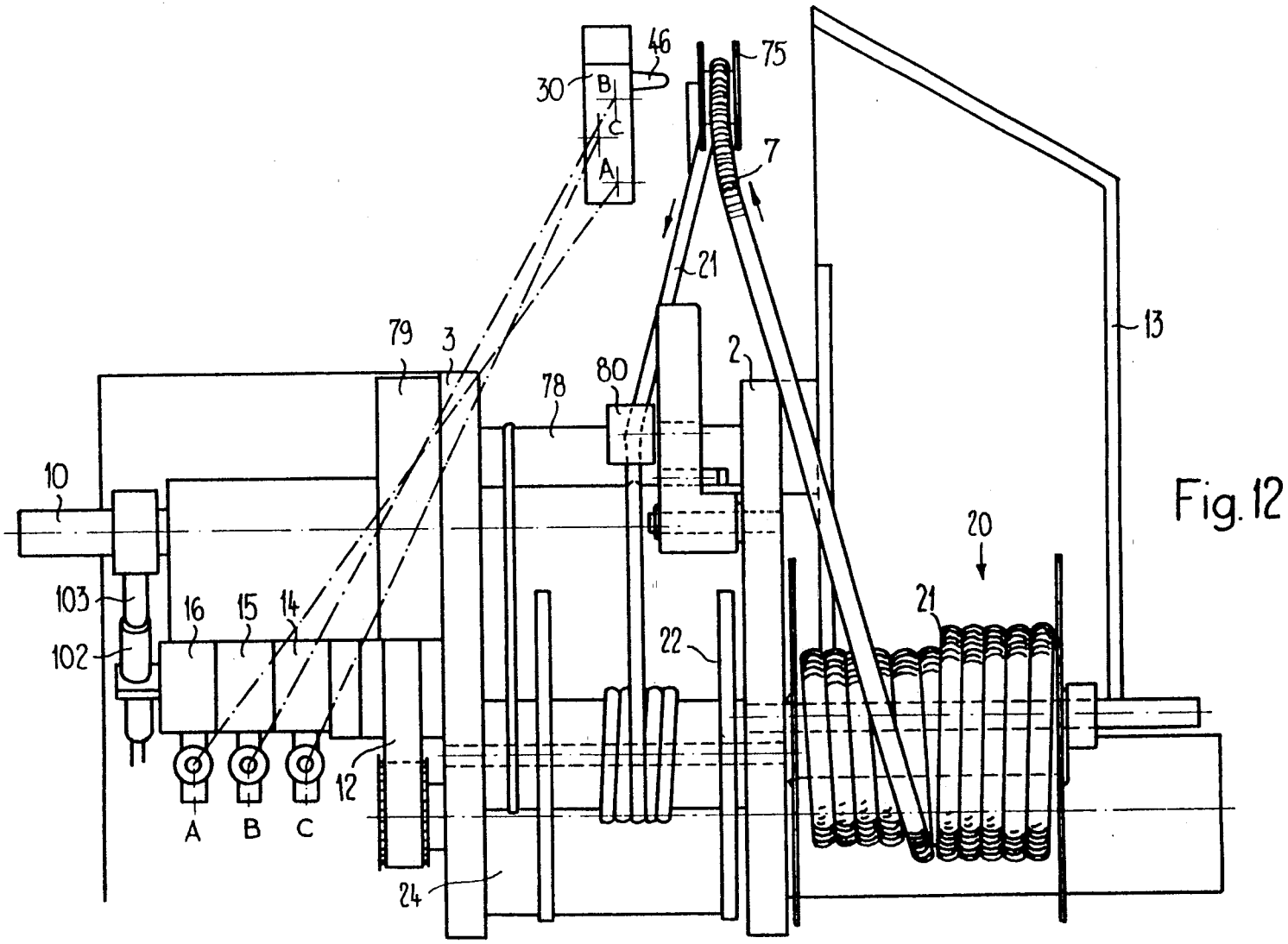
Figures 13, 14:
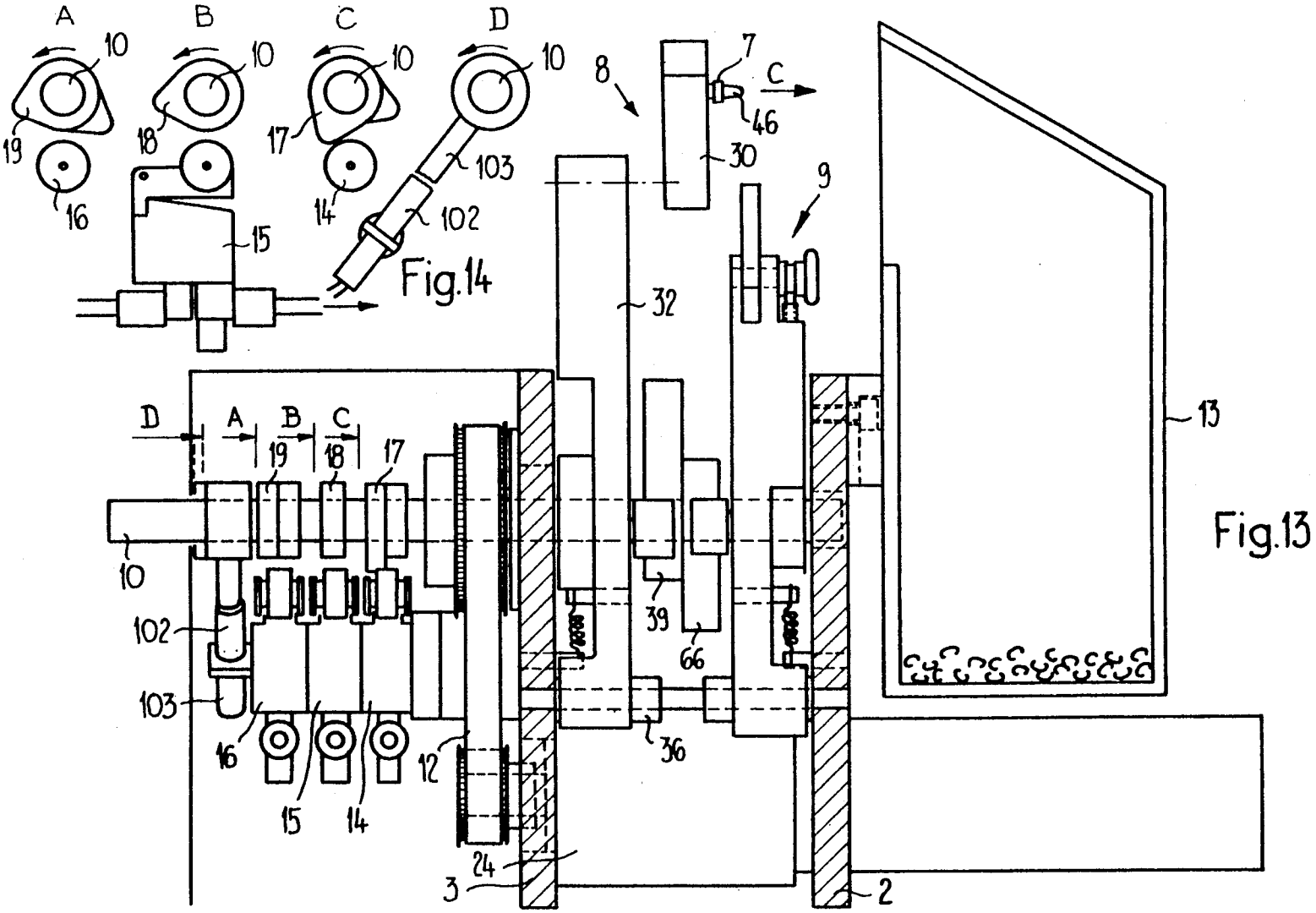

FIG. 3 is a plan view of a cutout of the front of the head piece of the lift-out device;

FIG. 4 is a bottom view of the head piece of the lift-out device;

FIG. 5 is a detailed view of the head piece in position when latching a ring traveler;

FIG. 6 is a detailed view of a head piece in a position moving away sideways, in relation to FIG. 5;

FIG. 7 is a side view of a portion of the device for attaching a new ring traveler, viewed across cross-sectional line 7—7 in FIG. 1;

FIG. 8 is a cutout view from the front end of the apparatus and the ring traveler attachment device, with a magazine rod in the position at the spinning ring;

FIG. 9 is a plan view of the front portion of the device shown in FIG. 7 and in the position according to FIG. 8;

FIG. 10 is a cutout side view of the front portion of the apparatus in a chronologically later position at the spinning ring;

FIG. 11 is a cutout front view from the top of the front end of the apparatus in the same position as in FIG. 10;

FIG. 12 is a rear view of a ring traveler magazine looking along arrow K in FIG. 1;

FIG. 13 is a cross-sectional view through line 13—13 in FIG. 1, showing diagrammatically the cam control of the two devices and the valves; and FIG. 14 is a schematic depiction of cam and valve operations of the apparatus.

DETAILED DESCRIPTION OF THE PREFERRED EMBODIMENT

Reviewing now the drawings, wherein like numerals reflect like elements throughout the various views, the apparatus for replacement of ring travelers is depicted, in plan view in FIG. 1, as preferably comprising generally housing 1 and planar support members 2 and 3 held parallel to each other by spacer bolts (not shown). Housing 1 is movable along a spinning machine, directly in front of the machines ring rail 4, preferably in direct connection with a doffing or threading trolley. FIG. 3 depicts a plan view of an end region of a spindle rail with spinning ring 6 containing a ring traveler 7 to be replaced by the present invention.

The apparatus comprises within housing 1, a lift-out device 8, which is mobile along a first vertical plane within the housing 1, as well as a device 9 mobile along a second plane, for attaching a new ring traveler. The second plane is parallel to the first plane.

A common control shaft 10 passes transversely through both support members 2 and 3 and facilitates movement of both the lift-out 8 and the attachment device 9. The control shaft 10 is driven by a motor 24, a belt pulley Il and drive belt 12. A collection container 13 for the ring travelers removed by the lifting-out device 8 is fixed at housing 1 next to the support member 2. The ring traveler 7 is positioned by compressed air upon the spinning ring 6 into the correct position for lifting-out and removal into collection container 13. Three 2-way valves 14, 15 and 16, actuated at different points in time during one working cycle by their respective control cams 17, 18 and 19 located on the common control shaft 10 behind the belt drive 11, facilitate the use of compressed air to aid in the operation of the apparatus.

The ring travelers 7 to be supplied to the attachment device 9 come from a magazine coil 20 at the side of housing 1. The magazine coil comprises a reel 21 including a string having a plurality of ring travelers 7 along it. The ring travelers 7 are separated from the string in the attachment device 9. The string is then coiled on a second coil 22 around shaft 23 which is between support members 2 and 3. The shaft-string-coil assembly is driven in a rotating manner.

The lift-out device 8, shown in detail in FIG. 2, is used to replace a ring traveler and moves and operates between an operating position (as shown) and an off position (shown in dashed lines). The device 8 comprises a head piece 30, which functions as a receptacle for one ring traveler 7. The head piece 30 is moved by a first guide system comprising two movably connected levers 31, 32, and a second guide system comprising inter-connected levers 33, 34 and 35. Levers 31 and 33 are connected to the head piece 30. Lever 32 is pivotably connected at axis 36 at the support member 3 of the housing 1 and includes roller 37 which is held in tension by a spring 38 against an eccentric cam 39 on the common control shaft 10 and is driven by drive belt 12. Roller 37 is pressed against eccentric cam 39 and arrives into position 37*a*, the off position (shown also in dashed-dotted lines), in the course of the control shaft 10 performing one revolution during a working cycle.

A short horizontal pulling motion, necessary for lifting a ring traveler 7 from the spinning ring 6, is accomplished by pivoting slightly leftward middle lever 34 of the second guide system. Lever 34 is pivoted with respect to axis 40 at the support member 3 by the force of compression spring 41 abutted at the support member 3 and at the lower portion of lever 34 when the position of lever 35 is changed by eccentric cam 42 on the common control shaft 10. The position then achieved is shown in dash-dotted lines.

Figure 2B:
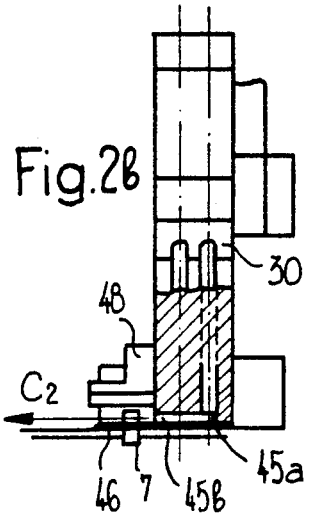
Figure 2A:
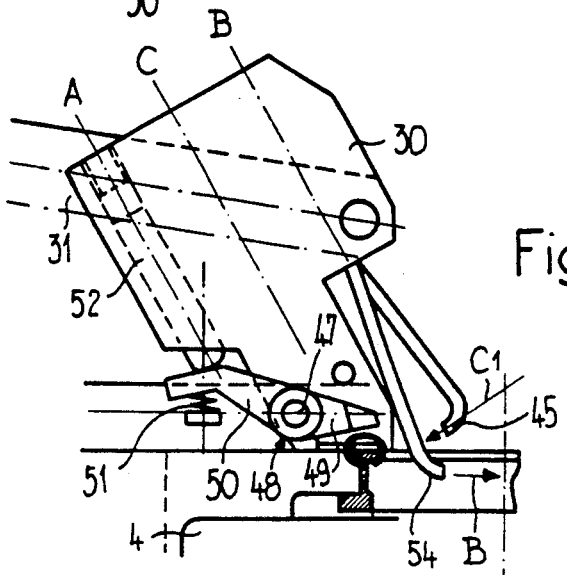

The unlatching of a ring traveler 7 is depicted in more detail in FIG. 5. Head piece 30 of device 8 is pivoted downward against spinning ring 6. The ring traveler 7 can be located in a set-up region of the head piece 30 and must first be conveyed out of this region prior to the head piece 30 setting on the spinning ring. This conveyance is accomplished by a compressed, outwardly extending air nozzle 45 (see FIG. 3) projecting from head piece 30. An air stream is blown through nozzle 45 along the direction of the arrow $C_1$ (see FIG. 2*a* and 2*b*) to permit a ring traveler in the setting region of head piece 30 to assume a position outside of the spinning ring 6 (see FIG. 3).

FIG. 3 shows head piece 30 from above in cutout-wise section in the position according to FIG. 2 and FIG. 4 depicts head piece 30 from the bottom, revealing a tapered pin 46. A twin-armed clamping jaw 48, pivotally supported on the side of the head piece 30 by pivot lug 47, cooperates with the tapered pin 46 (see FIG. 2*a* and 3). Arm 49 (see FIG. 2*a*) of the clamping jaw 48 is pressed under the force of compression spring 51, against pin 46 or against a ring traveler on the pin and also against the other arm 50 of the clamping jaw 48. The clamping jaw 48 must be released twice during the course of one working cycle so that the arm 49 lifts off pin 46. The release is achieved by a piston cylinder unit 52, operated by compressed air through head piece 30 through junction A such that clamping jaw 48 is swiveled into an open position. The compressed air lines are not shown. Compressed air through the other compressed air junctions B and C helps transport the ring traveler 7 from setting region of the head piece. From the same channel, another channel 45*a* leads to a blow-out aperture 45*b*, discharging an air stream above and parallel to pin 46 FIG. 2*b* and 4).

If, by actuating clamping jaw 48, arm 49 is lifted off pin 46, an additional motion impulse is imparted upon ring traveler 7 through compressed air junction B and out of nozzle 54 (see FIG. 3). The compressed air discharged through nozzle 54 travels tangentially and internally in the spinning ring 6 along arrow B, conveying the ring traveler 7 onto pin 46. Clamping jaw 48 which has been released for a short time by the force of the piston-cylinder unit 52 then clamps the ring traveler 7 on the pin 46.

FIGS. 5 and 6 depict two additional phases of motion of head piece 40 when removing a ring traveler 7 from the spinning ring 6. Ring traveler 7, retained by the clamping jaw 48, is unlatched according to FIG. 5 by a swiveling motion of head piece 30 (position changed compared to FIG. 2*a*) and subsequently is moved radially away (see FIG. 6) from the spinning ring 6 in order to enable head piece 30 to swivel upwards into the out-of-operation position. In this position the clamping jaw 48 is again actuated through the compressed air junction A to release the clamped ring traveler 7. Compressed air is then again blown through compressed air junction C through a channel 45*a* (FIG. 2*b*) in the direction of the arrow C2 (see FIGS. 2*b*, and 4) exiting the bottom of head piece 30 above pin 46. The ring traveler 7 is conveyed transversely above the device 9 into the collection container 13 so that a new ring traveler may be attached.

The principle of the cam control for the three compressed air junctions A, B and C in the head piece 30 is schematically shown in FIG. 14 where the arrows depict the direction of revolution of the cams. Twin cam 17 actuates its corresponding valves 14, shown with only one roller, so that the air stream C conveys the ring traveler 7 out of the setting region of the head piece 30 of the lift-out device 8. Subsequently, twin cam 19 actuates the corresponding valve 16 in order to release the clamping jaws 48, whereupon the sole cam 18 triggers tangential air stream B at the inner side of the spinning ring 6. The twin cam 19 is actuated for release of the clamping jaw 48 in order to blow the ring traveler away. At the end of each work cycle, twin cam 17 is again actuated for the air stream C2 exiting blower aperture 45*b* for blowing the ring traveler into collection container 13.

The apparatus, shown in plan view in FIG. 1, comprises both the lift-out device 8, which is mobile along the first vertical plane and the device 9 for attaching a new ring traveler, which is mobile along a second vertical plane, parallel to the first plane. The attachment device 9 is shown in detail in FIGS. 7 to 11. The device 9 is moved from the out-of-operation position, shown in FIG. 7, by cam control means, into the operational position and is similarly returned. The lift-out device 8 operates along the same principles.

The attachment device 9 operates, in greater detail, as follows. The device 9 includes a guide plate 60, inclined obliquely downwards with respect to the housing 1 and towards the ring rail 4 of the spinning machine. The guide plate 60 is fastened to a first guide member comprising lever 61 and second guide system comprising levers 62, 63. Guide member 61 is pivotally supported at the support members 2, 3 by a continuous axis 36. Roller 65 secured to guide member 61 rests against the eccentric cam 66. Cam 66 rotates around the common control shaft causing guide plate 60 and, therefore, device 9 to move forward and backward so that a new ring traveler may be attached. The short upward and downward motion necessary for slinging a new ring traveler 7 onto a spinning ring 6 is caused by the second guide system of levers 62, 63, wherein lever 63 is supported by pivot axis 67 at member 3 and carries roller 68 at its end. Roller 68 is pressed against an additional eccentric cam 69, also revolving around common control shaft 10. When eccentric cam 69 revolves, lever 62 imparts an up and down movement to guide plate 60.

The guide plate 60 and the guide member 70 may move relative to each other because of a compression spring 71 abutting the plate 60 and the member 71. A magazine rod 74, having a plurality of ring travellers strung along it, is rigidly connected to guide member 70 by a front splice plate 72 and a rear splice plate 73. The magazine rod 74 is parallel to guide member 70. The ring travelers 7 are fed to the magazine rod 74 by string 21 which is coiled upon a reel (see FIG. 1). The string 21 contains the ring travelers and is passed over a reversing roller 75, rotatably supported at the end of the guide member 70. The string 21 further travels along the end segment 76 of the magazine rod 74, containing a groove at the bottom. At this juncture, the ring travelers separate from the string traveling in the groove and runs through a reversing guide 77 to a strap drive shaft 78 which is driven by motor 79 outside the housing (see FIG. 1) and which cooperates with a counter-pressure roller 80. A traveler filling status initiator 81 above magazine rod 74 provides a signal that the rated filling status on the magazine rod has fallen below an allowable limit.

As best seen in FIG. 9, magazine rod 74 has an insertion hook 82 at its front end. The ring traveler 7 on the spinning ring 6 must first be clamped onto insertion hook 82 and then must be released. (See FIGS. 8 and 10). The severance and clamping is pivotally facilitated by hinge pin 83 at the front end of the guide plate 60 and a twin-arm lever clamp 84. One lever arm 85, includes at its front end, a severance and clamping plate 86, which separates the foremost ring traveler 7 from the ring traveler supply and clamps it at the front end of the magazine rod 74 until the position of the apparatus shown in FIG. 8 has been reached. The ring traveler, in its position as shown in FIG. 8, can then be slung over the upper edge of the spinning ring 6, while it is held tight. The remaining ring traveler supply is held back by a leaf spring 105 pressed against magazine rod 74. In the subsequent return motion, the guide plate 60 and the guide member 70, together with the magazine rod 74, move relative to each other against the action of the compression spring 71. Stop 88, fixed to lever arm 85 of clamp 84, extends downwards in the form of a pin. An additional stop, in the shape of an adjustable stop screw 90, is arranged in support member 89, which is rigidly connected to guide member 70. The screw head of stop screw 90 is screwed against the ring traveler 7, acting as a spacing indicator for the width of the ring traveler, i.e., it is clamped between the screw head and the support member 89.

As seen in FIG. 10, if the magazine rod 74 is fixedly held and the guide plate 60 moves rearward relative to it, the stop 88 will come into contact with stop screw 90, so that the clamping element 84 is pivoted, whereby the ring traveler sitting upon the insertion hook 82 is released. The second lever arm 91 of the clamping element 84 is pivoted, whereby the ring traveler sitting upon the insertion hook 82 is released. The second lever arm 91 is pivoted against the action of a leaf spring 92 so that it returns to its original position under the action of the leaf spring 92 when the stops 88 and 90 move away from each other. Spring 92 thus facilitates the clamping action for retaining a ring traveler, as shown in FIGS. 7 and 8.

The position of the magazine rod 74 at the start of the hanging or slinging of the ring traveler, as shown in FIG. 8, corresponds to the position shown in FIG. 9 in plan view, but without the clamping element 84 in order to show an additional stop 95 which cooperates with the insert hook 82 at the end of the magazine rod 74. The stop 95 is conceived as a twin-arm lever, prevents the ring traveler from falling off this hook end and is pivotably supported at the support member 89 by a hinge pin 96. The rear lever arm 97 of the twin-armed lever carries an opening cam 98 which, during the return motion of the guide member 70, drives together with the magazine rod 74 against an opening pin 99 which is oriented perpendicularly upwards at the portion of the housing 1. Thus, the twin-armed stop lever 95 is pivoted against the action of spring 100 and the front lever arm end is released from the insertion hook 82 and the ring traveler is released. (See FIG. 11). The latched ring traveler is therefore not overstretched in the course of a further rearward movement of the insertion hook 82. This operational cycle is finished with the latching of the ring traveler and the return of the apparatus 9 into the off position.

Each revolution of the shaft 10 of the apparatus corresponds to one working cycle and is detected by a revolution initiator 102 (see FIGS. 1 and 13) located subsequent to the valves and cooperates with pin 103 on the shaft 10. The pin travels past the initiator once with each revolution of the shaft. The shaft 10 drives and controls all motion sequences of the two devices 8 and 9, functioning in parallel planes and for controlling the nozzles which facilitate the proper operation of the lift-out device 8.

While the preferred embodiment of the invention has been described in detail, it is to be expressly understood that variations and modifications thereof may be adopted without departing from the spirit and scope of the invention, as defined in the following claims.

What is claimed is:

1. An apparatus for replacing ring travellers on spinning or twisting rings comprising:

a housing having two substantially parallel first and second walls defining substantially parallel first and second planes;

a lift-out device for lifting out a ring traveller, said lift-out device having:

a pin for supporting the ring traveller in a lift-out position thereof;

means for imparting a motion impulse to the ring traveller for positioning the ring traveller on said pin; and an actuatable clamping organ for retaining the ring traveller on said pin;

first motion links movably supported in said housing and connected with said lift-out device, said motion links being movable in said first plane between an operations position and an off position thereof;

a device for attaching a new ring traveller, said attaching device being movable in said second plane between an operational position and an off position thereof and including:

a ring traveller magazine containing a plurality of strung ring travellers;

means for feeding an individual ring traveller from said magazine and for retaining the individual ring traveller at an end of said magazine;

stop means cooperating with said magazine for retaining the individual ring traveller at said end; and second motion links movably supported in said housing and connected with said attaching device for moving said attaching device between operational and off positions thereof.

2. The apparatus of claim 1, wherein said lift-out device further comprises a head piece, said pin extending from said head piece;

wherein said first motion links comprises a first guidance system and a second guidance system for displacing said head piece;

wherein said clamping organ is pivotally supported at a side of said head piece and has first and second arms; and wherein said apparatus further comprises a spring for pressing the first arm against one of said pin and the ring traveller, and pressure-operated means acting on the second arm for releasing said clamping organ.

3. The apparatus of claim 1, wherein said motion imparting means comprises:

a first nozzle for providing a first pressure above a spinning ring and obliquely back against said head piece;

a second nozzle for providing a second pressure chronologically offset relative to the first pressure to an inside of the spinning ring along its inner circumference to position the ring traveler in a lifted-out position thereof on said pin; and a blow-out aperture discharging over said pin for blowing the ring traveller from said pin into an off position.

4. The apparatus of claim 3, wherein said head piece has a plurality of through channels for feeding a pressure medium to said nozzles and said blow-out aperture, and an additional through-channel for feeding the pressure medium to said pressure-operated means;

wherein said apparatus further comprises valve means for controlling flow of the pressure medium in said through-channels and cam means for controlling operation of said valve means; and wherein said pressure-operated means comprise a piston-cylinder unit integrated into said head piece.

5. The apparatus of claim 4, wherein said valve means includes a first valve for controlling flow of the pressure medium to said first nozzle and said blow-out aperture; and wherein said cam means includes a first rotatable twin cam for effecting a two-fold chronologically offset actuation of said first valve during one revolution of said first twin cam, a first actuation of said first valve providing for blowing away the ring traveller, which is located on the spinning ring beneath the said head piece and the pin, and a second actuation of said first valve providing for blowing the ring traveller positioned on said pin, at an end of a working cycle, into a collection container.

6. The apparatus of claim 4, wherein said valve means includes a second valve for controlling flow to said piston-cylinder unit, and wherein said cam means includes a second rotatable twin cam for effecting a two-fold chronologically offset actuation of said second valve during one revolution of said second twin cam, a first actuation of said second valve providing for canceling a clamping action of said clamping organ (48) during positioning of the ring traveler on said pin, and a second actuation of said second valve providing for canceling a clamping action of said clamping organ when the ring traveler is blown away from said pin into a collection container.

7. The apparatus of claim 4, further comprising first and second rotatable cams cooperating with respective guides of said first and second guidance systems for operating same to provide for displacement of said head piece in a vertical plane for unlatching the ring traveler from the spinning ring and, thereafter, to provide for displacement of said head piece horizontally form the spinning ring in a radial direction outwardly and further along an arc upwardly into an initial position thereof.

8. The apparatus of claim 1, wherein said ring traveller magazine comprises a magazine rod with the ring travelers strung thereon, and an insertion hook bent at an angle at a front end of said rod; and wherein said attaching device further comprises:

a guide member extending parallel to said rod and fixedly connected therewith, and a guide plate in which said guide member is longitudinally displaceable, said second motion links including a first guide lever for moving said guide plate between operational and off positions, and second guide levers for a limited up and down movement of said guide plate with a simultaneous guide movement in a plane perpendicular to said housing; and wherein said apparatus further comprises support means for supporting said first guide lever and said second guide levers, respectively, cam means for actuating said first and second guide levers, and a shaft located in said housing for supporting said cam means.

9. The apparatus of claim 8, further comprising:

a clamping element arranged at said guide plate and pivotal between two positions for displacing a foremost ring traveler of the plurality of ring travelers strung on said rod to said insertion hook and for clamping the foremost ring traveler on said insertion hook prior to a transfer-over operation;

a stop spring for retaining the plurality of ring travelers on said rod;

a compression spring supported against said guide plate and said guide member for retaining said guide plate and said guide member in a predetermined position relative to each other; and stop means for retaining said clamping element in a clamping position thereof, said guide plate being movable against a biasing force of said compression spring to provide for movement of said guide plate, said guide member and said rod relative to each other, which relative movement results in said stop means releasing said clamping element, whereby the ring traveller retained on said insertion hook is released.

10. The apparatus of claim 9, wherein said clamping element comprises a twin-armed lever pivotally supported at said guide plate above said rod, a clamping plate arranged at an end of one lever arm and extending obliquely to said rod, and a spring supported against another lever arm for biasing said clamping plate against the foremost ring traveler, said stop means comprising a first stop arranged on said one lever arm and extending therefrom in a pivot plane of said twin-armed lever and an adjustable second stop formed as a screw and arranged on said guide member, said first stop being movable against said second stop, during relative movement of said guide plate, to provide for pivoting of said clamping plate away form said rod.

11. The apparatus of claim 10, wherein said stop means further comprises:

a support member fixedly secured to said guide member, the screw head of said second stop being placed against the ring traveler and being used as a distance indicator of the width of the ring travelers, said apparatus further comprising an additional lever-shaped stop cooperating with said insertion hook;

support mean for pivotally supporting said lever-shaped stop in a plane perpendicular to a plane of movement of said guide plate for preventing the ring traveler form falling off said insertion hook;

an opening cam movable against an opening pin for moving said additional lever-shaped stop to an off position thereof, said opening cam being displaced radially to the spinning ring at said housing after insertion of the ring traveler during an initial phase of a return motion of said attaching device for attaching a new ring traveler, and for releasing the ring traveler after it has been latched by pivoting said lever-shaped stop away form the insertion hook.

12. The apparatus of claim 8, wherein said attaching device further comprises a reversing roller for a string containing a plurality of ring traveler s and supported at an end of said guide member beneath said rod said rod having a grooved segment at a bottom side thereof and said string being conducted into said grooved segment to provide for separation of ring travelers therefrom; and wherein said apparatus further comprises a first bobbin supported at said housing, a clamp roller drive arranged in said housing for winding said string onto said first bobbin upon reversal of movement of said string after the separation of the ring travelers therefrom, and a second bobbin supported at said housing for supporting said string with the ring travelers thereon, and means for switching said clamping roller drive on within time intervals, said switching means comprising a sensor arranged above said rod for inductive checking of a filling status of the ring travelers on said rod.

13. The apparatus of claim 7, further comprising a shaft rotatably supported in said housing for supporting said first and second cams, a motor for rotating said shaft, and additional cam means for actuating said second motion links and supported on said shaft, said shaft also supporting said cam means and performing one revolution for one working cycle.

* * * * *